US006446553B1

(12) United States Patent
Costin et al.

(10) Patent No.: US 6,446,553 B1
(45) Date of Patent: Sep. 10, 2002

(54) PRINTING APPARATUS

(76) Inventors: John Ian Costin, 40 Knot Lane, Walton-le-Dale, Preston, Lancashire (GB); Howard Stephen Carsley, 145, Anchorsholme Lane East, Thorton Cleveleys, FY5 3BS, Lancashire (GB); Peter Andrew Donaldson, 14 St Walburges Gardens Ashton, Preston, PR2 2QJ, Lancashire (GB)

( * ) Notice: Subject to any disclaimer, the term of this patent is extended or adjusted under 35 U.S.C. 154(b) by 0 days.

(21) Appl. No.: 09/091,025

(22) PCT Filed: Oct. 10, 1997

(86) PCT No.: PCT/GB97/02804

§ 371 (c)(1),
(2), (4) Date: Jun. 28, 1999

(87) PCT Pub. No.: WO98/16384

PCT Pub. Date: Apr. 23, 1998

(30) Foreign Application Priority Data

Oct. 12, 1996 (GB) ..... 9621324

(51) Int. Cl.[7] ..... B41F 5/02
(52) U.S. Cl. ..... 101/183; 101/180; 101/181
(58) Field of Search ..... 101/180, 181, 101/183, 178, 484

(56) References Cited

U.S. PATENT DOCUMENTS 3,557,692 A * 1/1971 Lee ..... 101/177
4,527,788 A * 7/1985 Masuda ..... 101/248
4,694,749 A * 9/1987 Takeuchi et al. ..... 101/181 X
5,263,413 A 11/1993 Ikeguchi ..... 101/183
5,309,834 A * 5/1994 Koch ..... 101/248
5,481,971 A * 1/1996 Grutzmacher et al. ..... 101/183
5,826,505 A * 10/1998 Volz et al. ..... 101/183

FOREIGN PATENT DOCUMENTS

| | | |
|---|---|---|
| DE | 40 31 964 A1 | 4/1992 |
| DE | 41 37 979 A1 | 5/1993 |
| EP | 0 709 184 A1 | 5/1996 |
| GB | 2 149 149 A | 6/1985 |
| GB | 2 261 629 A | 5/1993 |

* cited by examiner

*Primary Examiner*—Andrew H. Hirshfeld
*Assistant Examiner*—Minh H Chau
(74) *Attorney, Agent, or Firm*—Marshall, Gerstein & Borun

(57) ABSTRACT

A drive system for use with a printing apparatus is disclosed. The drive system includes a plurality of process units, with each unit being adapted for effecting a respective repeat operation on a web of material fed along a path defined at least in part by the process units. The drive system further includes an electrically powered rotary motor corresponding to each of the process units or to one or more rotary elements within a process unit. A control system operates to regulate the running speed and angular phasing of each of the motors individually in relation to a predetermined master standard programmed into the control system. The control system is adapted to vary the relative phase angles of the outputs of one or more of the rotary motors by a preselected factor proportionate to the overall running speed of the apparatus in order to maintain accurate registration of each of the process units relative to the web material throughout a substantial range of operating speeds.

8 Claims, 1 Drawing Sheet

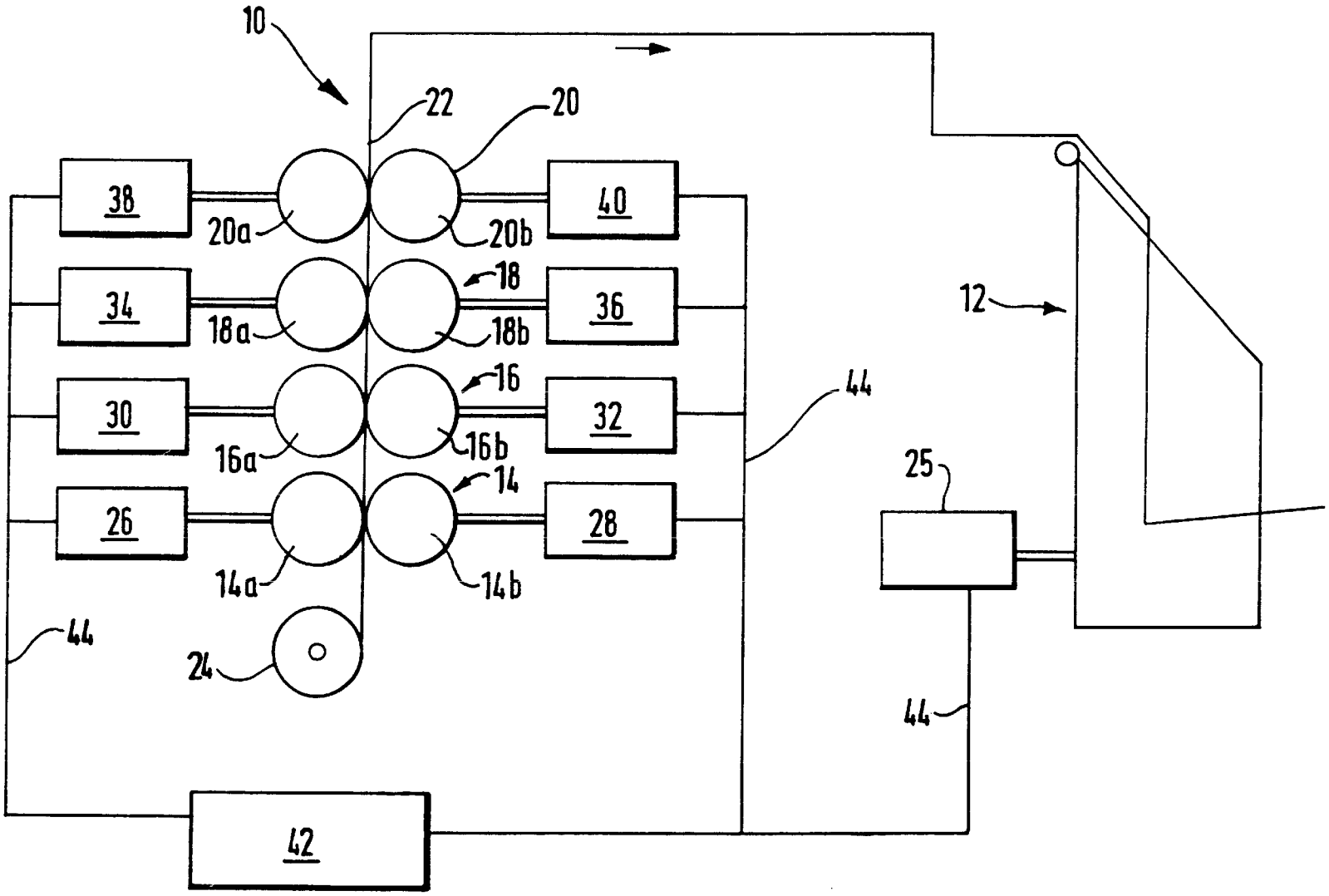
10
12
14
14a
14b
16
16a
16b
18
18a
18b
20
20a
20b
22
24
25
26
28
30
32
34
36
38
40
42
44
44
44

PRINTING APPARATUS

FIELD OF THE INVENTION

This invention relates to printing apparatus, particularly for highspeed rotary multicolour web printing as by the offset process in the production of newspapers and periodicals though the invention may have application to other types of single or multicolour web or sheet fed printing processes and apparatus.

BACKGROUND OF THE INVENTION

It is known to provide printing apparatus having individual process units each driven mechanically independently by its own electric motor instead of coupling the units together by shafts, gearing etc to be driven in synchronism from a common motor. The individual motors are of a type which can be extremely accurately controlled electrically as to running speed and angular position of their drive output to provide synchronisation of the various units and accurate registration of their respective operations on the web or material being processed. This kind of drive arrangement is commonly referred to as "shaftless drive" and many examples are well known in the art such as in our GB 2149149A.

Although shaftless drive is successful in providing accurate and consistent results when the printing apparatus is running at its service speed, problems arise which have not hitherto been solved during changes in operating speed of the apparatus as a whole and, consequently, the linear speed of the web, due mainly to stretching or other distortion of the web consequent upon the speed change. This results in the operations carried out by the different units becoming out of register, for example registration of different colours in multicolour printing is lost giving rise to substantial wastage and loss of production time.

The apparatus has to be run up to speed on start-up and has to be run down again to close down giving wastage at the beginning and end of every print run.

SUMMARY OF THE INVENTION

The object of the invention is to provide printing apparatus having shaftless drive with all its consequent advantages and which is able to maintain accurate synchronisation and registration throughout substantial changes in overall running speed.

According to a first aspect of the invention there is provided drive means for printing apparatus of the kind comprising a plurality of process units each for effecting a respective repeat operation on web or sheet material fed along a feed path defined at least in part by said units; said drive means comprising an electrically powered rotary motor individual to each said unit or to one or more rotary elements within a unit, and control means operating to regulate the running speed and angular phasing of each said motor individually in relation to a predetermined master standard programmed in to the control means: characterised in that the control means further includes speed correction means for varying the relative phase angles of one or more of the motor drive outputs by a preselected factor proportionate to the overall running speed of the apparatus to maintain accurate registration relative to the material of the various operations carried out by said units throughout a substantial range of operating speeds.

The invention further resides in a method of operating printing apparatus incorporating shaftless drive including the steps of determining the extent of registration error caused by changes in overall operating speed taking place without any adjustment in relative speed of individual drive motors or changes in relative angular phasing of their drive outputs to provide an algorithm representing register error as a function of said operating speed, and applying that algorithm automatically to vary the relative phase angles of one or more of the motor drive outputs by a preselected factor proportionate to the overall running speed of the apparatus whereby registration is correctly maintained throughout a substantial range of operating speeds.

BRIEF DESCRIPTION OF THE DRAWING

The FIGURE shows a view of an embodiment of the present invention.

DETAILED DESCRIPTION

An example of the invention is now more particularly described with reference to the accompanying drawing being a diagram of continuous web multicolour offset printing apparatus.

The apparatus comprises a web-fed four colour printing line 10 and a folder 12 downstream thereof, thus the apparatus shown consists basically of five process units, four successive colour units 14, 16, 18, 20 and folder unit 12.

The continuous web 22 passes from a reel or other source 24 along printing line 10 and then to folder unit 12 in conventional manner.

The colour units 14–20 are of conventional construction incorporating plate and blanket cylinders and dampening and ink roll trains well known in the art and therefore not detailed in the drawing.

However each of the units is independently driven by respective electric motors of known type capable of very accurate electrical control of their running speed and of the angular position of their drive outputs, this shaftless drive arrangement dispensing with the need for mechanical coupling of the individual units.

Folder unit 12 is individually driven by a said motor 25.

In this particular example each colour unit 14–20 incorporates two said drive motors. Taking unit 14 it has a drive motor 26 powering a first roll or cylinder couple 14*a* and another drive motor 28 powering couple 14*b*.

In the same way unit 16 has motors 30 and 32 driving couple 16*a* and 16*b* respectively; unit 18 has motors 34 and 36 driving couples 18*a* and 18*b* respectively; and unit 20 has motors 38 and 40 driving couples 20*a* and 20*b* respectively.

Each of the nine drive motors 25–40 is linked to an electronic control unit 42 by control circuitry 44. Unit 42 operates to regulate the running speed and relative angular phasing of the motors so that the operations of the various units are synchronised to provide accurate colour registration and correct positioning of the folding operations on web 22 with the apparatus as a whole running at its normal operating speed.

Control unit 42 is pre-programmed with a master standard from which all the motors are regulated and held in synchronisation, an arrangement which may be regarded as a virtual electrical line shaft equivalent to mechanically coupling together the various motor drive inputs, i.e. every motor is controlled as a slave from the master control unit 42. This avoids reliance on servo regulation by closed loop or other feedback from scanning operational parameters such as shaft speed and/or web speed at a given point or points as it has been found in practice that reliance on such servo control systems does not give fast enough response for high quality results at high rates of production.

Experiments have shown, surprisingly, that changes in overall operating speed as when starting up or closing down a print run have a constant and therefore predictable effect on registration. Repeat test runs and accurate measurement of the degree of, for example, incorrect colour registration relative to changes in overall press speed enable an algorithm to be derived for programming the control unit 42 with data for automatic compensation relative to the overall running speed of the apparatus, automatically shifting the relative phase angles of the drive outputs of motors 25–40 individually by preselected factors.

The correction will vary depending on the operating relationship of the various units and of the roll couples or other individually driven rotary elements within a unit, thus the pair of drive motors, for example 26 and 28 of an individual unit e.g. 14 will normally be maintained in synchronism with each other but the relative phase angle between those motors and the motors of the other units 16–20 and 12 will be varied as a function of overall speed and will also be varied relative to each other.

Unexpectedly, once the algorithm and the required correction factors have been established accuracy of registration will be maintained, even in successive print runs, with little or no further setting resulting in substantial economies of time and trouble, e.g. when making ready, as well as a very substantial reduction in wastage as copies produced during speed changes, as when running up or closing down, will largely be of acceptable standard.

It will be understood that the invention may be applied to various shaftless drive arrangements, in some applications a motor may drive a single roll or cylinder either directly or through gearing, timing belts or other transmission means, in other applications the single motor may drive a train of rolls or cylinders or even an entire colour unit or other web or sheet process unit instead of driving a couple as described above.

What is claimed is:

1. Drive means for printing apparatus of the kind comprising a plurality of process units each for effecting a respective repeat operation on web or sheet material fed along a feed path defined at least in part by said units; said drive means comprising an electrically powered rotary motor individual to each said unit or to one or more rotary elements within a unit, and control means operating to regulate the running speed and angular phasing of each said motor individually in relation to a predetermined master standard programmed into the control means: characterised in that the control means further includes speed correction means for varying the relative phase angles of one or more of the motor drive outputs by a preselected factor proportionate to the overall running speed of the apparatus to maintain accurate registration relative to the material of the various operations carried out by said units throughout a substantial range of operating speeds.

2. Drive means as claimed in claim 1, wherein the drive means comprises at least two rotary motors to each unit, in each unit at least one rotary motor driving a rotary element to one side of the feed path and at least one rotary motor driving a rotary element to the other side of the feed path.

3. A method of operating printing apparatus incorporating shaftless drive including the steps of determining the extent of registration error caused by changes in overall operating speed taking place without any adjustment in relative speed of individual drive motors or changes in relative angular phasing of their drive outputs to provide an algorithm representing register error as a function of said operating speed, and applying that algorithm automatically to vary the relative phase angles of one or more of the motor drive outputs by a preselected factor proportionate to the overall running speed of the apparatus whereby registration is correctly maintained throughout a substantial range of operating speeds.

4. A drive system for use on a printing press, the printing press having a plurality of process units positioned to effect a printing operation on a web of material proceeding along a path defined in part by the process units, the drive system comprising:

an electrically powered rotary motor operatively associated with each of the process units; and control means for individually regulating the running speed and angular phasing of each of the motors relative to a predetermined master standard programmed into the control means, the control means being adapted to vary the relative phase angles of one or more of the motors by a preselected factor proportionate to the overall running speed of the printing press, the control means applying the preselected factor to vary the relative phase angles of one or more of the motors independent of actual speed measurements and actual phase measurements of the motors;

whereby accurate registration of each of the process units relative to the web of material is maintained throughout a substantial range of operating speeds.

5. The drive system of claim 4, wherein the control means further includes means for determining the extent of uncorrected registration error during changes in overall operating speed.

6. The drive system of claim 4, wherein the control means further includes means for calculating an algorithm representing registration error as a function of operating speed.

7. A method of operating a printing press having a shaftless drive system comprising the steps of:

determining empirically uncorrected registration error at a plurality of operating speeds caused by changes in overall operating speed;

providing a correction algorithm based on the uncorrected registration error, the correction algorithm providing a plurality of correction factors for a plurality of corresponding operating speeds, each of the correction factors being proportionate to an operating speed;

selecting an operating speed;

applying the correction factor to the drive system corresponding to the selected operating speed.

8. The method of claim 7, wherein the step of applying the correction factor includes the step of varying the phase angle of at least a portion of the drive system.

* * * * *

UNITED STATES PATENT AND TRADEMARK OFFICE

CERTIFICATE OF CORRECTION

PATENT NO. : 6,446,553 B1
DATED : September 10, 2002
INVENTOR(S) : Costin et al.

It is certified that error appears in the above-identified patent and that said Letters Patent is hereby corrected as shown below:

Title page,
Item [76], Inventors, please delete "John Ian Costin", and insert -- Ian John Costin --.

Column 3,
Line 43, delete "on web or sheet material" and insert -- on a web material --.
Lines 50-52, delete "means: characterized in that the control means further includes speed correction means for varying" and insert -- means, the control means being adapted to vary --.
Lines 55-56, delete "registration relative to the material of the various operations carried out by said units throughout" and insert -- registration of each of the process units relative to the web material throughout --.

Column 4,
Lines 6-7, delete "phasing of their drive outputs to provide an algorithm representing register error" and insert -- phasing of the drive motors, calculating an algorithm representing registration error --.
Lines 9-11, delete "the motor drive outputs by a preselected factor proportionate to the overall running speed" and insert -- the drive motors by a preselected factor proportionate to the overall operating speed --.

Signed and Sealed this

Seventh Day of January, 2003

JAMES E. ROGAN
*Director of the United States Patent and Trademark Office*